US007654898B2

(12) United States Patent
Vancura

(10) Patent No.: US 7,654,898 B2
(45) **Date of Patent: *Feb. 2, 2010**

(54) METHOD FOR SELECTING WILD SYMBOLS BY A PLAYER

(76) Inventor: Olaf Vancura, 4684 Stuttgart St., Las Vegas, NV (US) 89147

( * ) Notice: Subject to any disclaimer, the term of this patent is extended or adjusted under 35 U.S.C. 154(b) by 298 days.

This patent is subject to a terminal disclaimer.

(21) Appl. No.: 11/397,061

(22) Filed: Apr. 4, 2006

(65) Prior Publication Data

US 2006/0172796 A1 Aug. 3, 2006

Related U.S. Application Data

(63) Continuation of application No. 10/050,460, filed on Jan. 15, 2002, now Pat. No. 7,040,985.

(51) Int. Cl.
*A63F 9/24* (2006.01)

(52) U.S. Cl. ..... 463/20; 273/143 R; 463/25

(58) Field of Classification Search ..... 463/20
See application file for complete search history.

(56) References Cited

U.S. PATENT DOCUMENTS

| | | | |
|---|---|---|---|
| 4,448,419 | A | 5/1984 | Telnaes |
| 5,431,408 | A | 7/1995 | Adams |
| 5,695,402 | A | 12/1997 | Stupak |
| 5,947,821 | A | 9/1999 | Stone |
| 5,997,401 | A | 12/1999 | Crawford |
| 6,089,977 | A | 7/2000 | Bennett |
| 6,102,401 | A | 8/2000 | Segman et al. |
| 6,173,955 | B1 | 1/2001 | Perrie et al. |
| 6,193,235 | B1 | 2/2001 | Vancura et al. |
| 6,251,013 | B1 | 6/2001 | Bennett |
| 6,261,177 | B1 | 7/2001 | Bennett |
| 6,270,412 | B1 | 8/2001 | Crawford et al. |
| 6,290,600 | B1 | 9/2001 | Glasson |
| 6,305,686 | B1 | 10/2001 | Perrie et al. |
| 6,311,976 | B1 | 11/2001 | Yoseloff et al. |
| 6,322,309 | B1 | 11/2001 | Thomas et al. |
| 6,347,996 | B1 | 2/2002 | Gilmore et al. |
| 6,398,644 | B1 | 6/2002 | Perrie et al. |

(Continued)

*Primary Examiner*—John M Hotaling
*Assistant Examiner*—Marcus D Jones

(57) ABSTRACT

A method for playing a slot machine displays for a wager one matrix of random symbols for player selection of at least one symbol. Providing strategic information to the player for favorable play. Converting the at least one position associated with the at least one symbol selected to be wild and awarding the player in accord with available pay table and/or game rules. Allowing the player to make a wager and begin play of a reel slot machine having positions set in a matrix of columns and rows wherein symbols move during play in the columns and stop in perhaps one of the rows. After the reels stop the player selects one or more symbols in accord with the rules of play and/or pay table. The player applies strategy based on information available on the pay table and/or rules of play to select at least one symbol. The player qualifies for wild symbols by random achievement of triggering. An apparatus for strategically playing a casino slot machine for a wager has a display for pay table and/or rules of play information and a matrix presentation for each wager of symbols randomly positioned. With a selector the player chooses one or more symbols and a converter changes that to be wild for awarding according to the pay table and/or rules of play.

20 Claims, 10 Drawing Sheets

U.S. PATENT DOCUMENTS

| | | | |
|---|---|---|---|
| 6,439,993 | B1 | 8/2002 | O'Halloran |
| 6,481,713 | B2 | 11/2002 | Perrie et al. |
| 6,517,432 | B1 | 2/2003 | Jaffe |
| 6,517,433 | B2 | 2/2003 | Loose et al. |
| 6,565,088 | B2 | 5/2003 | Perrie et al. |
| 6,575,829 | B2 | 6/2003 | Coleman et al. |
| 6,604,740 | B1 | 8/2003 | Singer et al. |
| 6,616,142 | B2 | 9/2003 | Adams |
| 6,645,071 | B2 | 11/2003 | Perrie et al. |
| 6,648,758 | B2 | 11/2003 | Bennett et al. |
| 2002/0052233 | A1 | 5/2002 | Gauselmann |
| 2003/0125102 | A1 | 7/2003 | Cannon |

| | 1 | 2 | 3 | 4 | 5 |
|---|---|---|---|---|---|
| A | BELL | LIME | PLUM | LIME | PLUM |
| B | MELON | MELON | BELL | MELON | TRIGGER |
| C | LIME | PLUM | LOGO | LIME | BELL |

*Fig. 2*

| | 1 | 2 | 3 | 4 | 5 |
|---|---|---|---|---|---|
| A | LOGO | BELL | PLUM | PLUM | PLUM |
| B | BELL | LOGO | LIME | MELON | BELL |
| C | MELON | MELON | MELON | PLUM | MELON |

*Fig. 3*

| | 1 | 2 | 3 | 4 | 5 |
|---|---|---|---|---|---|
| A | LOGO | BELL | PLUM | PLUM | PLUM |
| B | BELL | LOGO | LIME | MELON | BELL |
| C | MELON | MELON | MELON | PLUM | TRIGGER |

*Fig. 4*

METHOD FOR SELECTING WILD SYMBOLS BY A PLAYER

CROSS REFERENCE TO RELATED APPLICATIONS

This application is a continuation of U.S. patent application Ser. No. 10/050,460 filed Jan. 15, 2002 now U.S. Pat. No. 7,040,985.

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention relates, in particular, to improvements in the methods and apparatus for slot machine play to enhance excitement utilizing wild symbols and strategy wherein sufficient information is provided to the player upon or within the machine so the optimal strategy may be calculable by the player.

2. Description of the Related Art Including Information Disclosed Under 37 CFR 1.97 and 1.98

Simply because players love wild symbols, the vast majority of new slot machines have at least one symbol denoted as wild. When stopped on a pay line, the wild symbol becomes a substitute for any other symbols. Sometimes these wild symbols substitute for all other pay combination symbols. In other words, the wild symbol may simultaneously take the form of any other symbol in order to create a winning pay combination. In other instances, the wild symbols substitute for only a subset of all other symbols. For example, the wild symbols might substitute for fruit-theme symbols but not beach-theme symbols. In still another well known try, a wild symbol may substitute for another symbol, provided that the other symbol also appears somewhere on the pay line.

Recently, games have appeared in which a "super-wild" symbol has special meaning. In at least two games (e.g., Atronic's "Break the Spell" game, IGT's "Munsters" game), a "super-wild" symbol in any position on a reel makes all the symbols on that same reel wild in succession. In another case (e.g., Aristocrat's "Penguin Pays" game), a "super-wild" symbol in any position makes all the symbols in any position on any reel wild in succession. Needless to say, these "super-wild" symbols are popular because the player generally wins a lot when they appear. Mathematically, they also enhance game volatility.

While the use of wild symbols increases player interest, and when appearing enhances player satisfaction, what has been lacking heretofore in any use of wild symbols is an element of skill in their regard. To date, the use of wild symbols is always a passive encounter with the player. There is no interaction on the part of the player. The ability of the player to have at least in some degree control the destiny of the game play is not in any wild symbol casino game. The desirability to players of their having some degree of control over the play of a wild symbol casino game has not been recognized or addressed.

Too, there exists a base game wherein the player, after every spin, must choose which reels to hold and which to re-spin (e.g., Silicon Gaming's line of slots). Player choice in that game and its resemblance to video poker player control is apparent. The player of a slot machine typically does not know the relative probability of receiving specific symbols and hence the optimal strategy for the slot play is unlike video poker play. The best strategy is not calculable by the player because the player is simply not given enough information. This frustrates players, who would like to make an educated guess in terms of strategy, but is simply not provided sufficient information via rules of play to do so. Indeed, for some games, even if the player knew the reel-strip layout, this is not sufficient information to calculate optimal strategy due to the widespread use of virtual reels see, e.g., U.S. Pat. No. 4,448,419.

U.S. Pat. No. 6,093,102 discloses the multi-line pay lines in a slot machine displaying a plurality of symbols in a matrix of n rows and m columns of symbol positions. A game control has images displayed and pays when a predetermined combination of symbols is displayed. A predetermined arrangement of symbol positions includes one and only one symbol position in each column of the array. The display has symbols in 3 rows and 3, 4 or 5 columns. U.S. Pat. No. 6,322,309 disclosures a typical slot machine for bonusing with touch screen selectable elements and is with the '102 patent incorporated herein by reference and made a part hereof as at least that which skilled artisans would know of regarding how a slot machine is made and operates.

Mikohn Gaming of Las Vegas, Nev. has shown (via, e.g., Yahtzee and Battleship slots) that players enjoy an element of skill in the form of a strategy bonus game, wherein the rules of play allow the player, in principle, to calculate an optimal strategy. Mikohn Gaming has also shown that players-enjoy an element of knowledge in the form of a trivia bonus game (e.g., Ripley's Believe It or Not! slot machines).

BRIEF SUMMARY OF THE INVENTION

Players want to have more to do than simply wager on the game and wait for the outcome and so slot machines have become more interactive. It is desirable to continue to improve methods of play wherein players interact with the game and affect the outcome of the game.

It is desirable to have players participate in a strategy-based component to the base game of a slot machine, wherein sufficient information is available to the players (upon or within the machine) for the optimal strategy to be calculable by the player. In a preferred embodiment, the reels are actual (not video virtual), but the optimal strategy would be calculable by the player in either. It is furthermore desirable to have the optimal strategy be fairly simple to derive, by the player, on a game by game basis.

It is desirable to have players participate in a strategy-based component to the base game of a slot machine, wherein wild symbols are used during play of the game. Because of players' affinity for wild symbols, it is especially desirable to have players participate in a strategy-based component of the base game, wherein the use or placement of one or more wild symbols and/or positions are a part of the decision making process.

The solution, as disclosed herein, achieves the aforementioned goals through the use of a player selectable wild position. Briefly, upon a triggering means as described below, the player is afforded the opportunity to select one or more of the symbol positions to become wild. In so doing, the player is afforded considerable control over the outcome of the game, and is given the opportunity to use strategy and/or skill.

A method for playing a slot machine has the steps of displaying for a wager one matrix of randomly set symbols for the player to select therefrom at least one symbol. Making strategic information available to the player so selection affords opportunities to play favorably. Converting the at least one position associated with the at least one symbol selected by the player to be wild and awarding the player in accord with available pay table and/or game rules.

A method for playing a slot machine has the steps of establishing and depicting the rules of play and/or a pay table so they are available to the player. Allowing the player to make a wager and begin play of a reel slot machine having positions set in a matrix of columns and rows wherein symbols move during play in the columns and stop in perhaps one of the rows. After the reels stop permitting the player to select one or more symbols in accord with information learned by the player from the rules of play and/or pay table. The slot machine may convert the positions associated with the one or more symbols selected to be wild, and awards the player according to the pay table and/or game rules.

A method for playing a slot machine strategically comprising the steps of displaying a random matrix of symbols and permitting the player to select at least one symbol. Then converting the at least one position associated with the at least one symbol selected to be wild and awarding the player in accord with a pay table and/or rules of play. The step of converting making all positions with that symbol to be wild or all positions wild and/or with those wild positions having an enhanced multiplier for any resultant pays. The step of having the enhanced multiplier randomly chosen. The random matrix has columns and rows with the step of converting all the positions in either a column or row. The step of permitting the player to apply strategy based on information available on the pay table and/or rules of play to select at least one symbol. The step of qualifying the player to go from the steps of displaying to permitting with random achievement of triggering.

An apparatus for strategically playing a casino slot machine for a wager has a display for pay table and/or rules of play information and a matrix presentation for each wager. The matrix presentation of symbols may be randomly positioned in the matrix. A selector is provided for the player to choose one or more symbols and a converter for the player changes the one or more symbols to be wild for awarding for symbols displayed in accord with the pay table and/or rules of play.

It is an advantage of the present invention that the player feels empowered to adjust the game play in accord with strategy.

It is an advantage of the present invention that the optimal strategy is not difficult to identify on a case by case basis.

It is a further advantage of the present invention that the player selects which symbol positions will become wild during play.

BRIEF DESCRIPTION OF THE DRAWINGS

FIG. 2 is a representation of another possible spin outcome demonstrating a form of the instant invention.

FIG. 3 is a representation of yet one more possible spin outcome.

FIG. 4 is a representation of still another possible spin outcome demonstrating the instant invention.

DETAILED DESCRIPTION OF THE INVENTION

Figure 5:
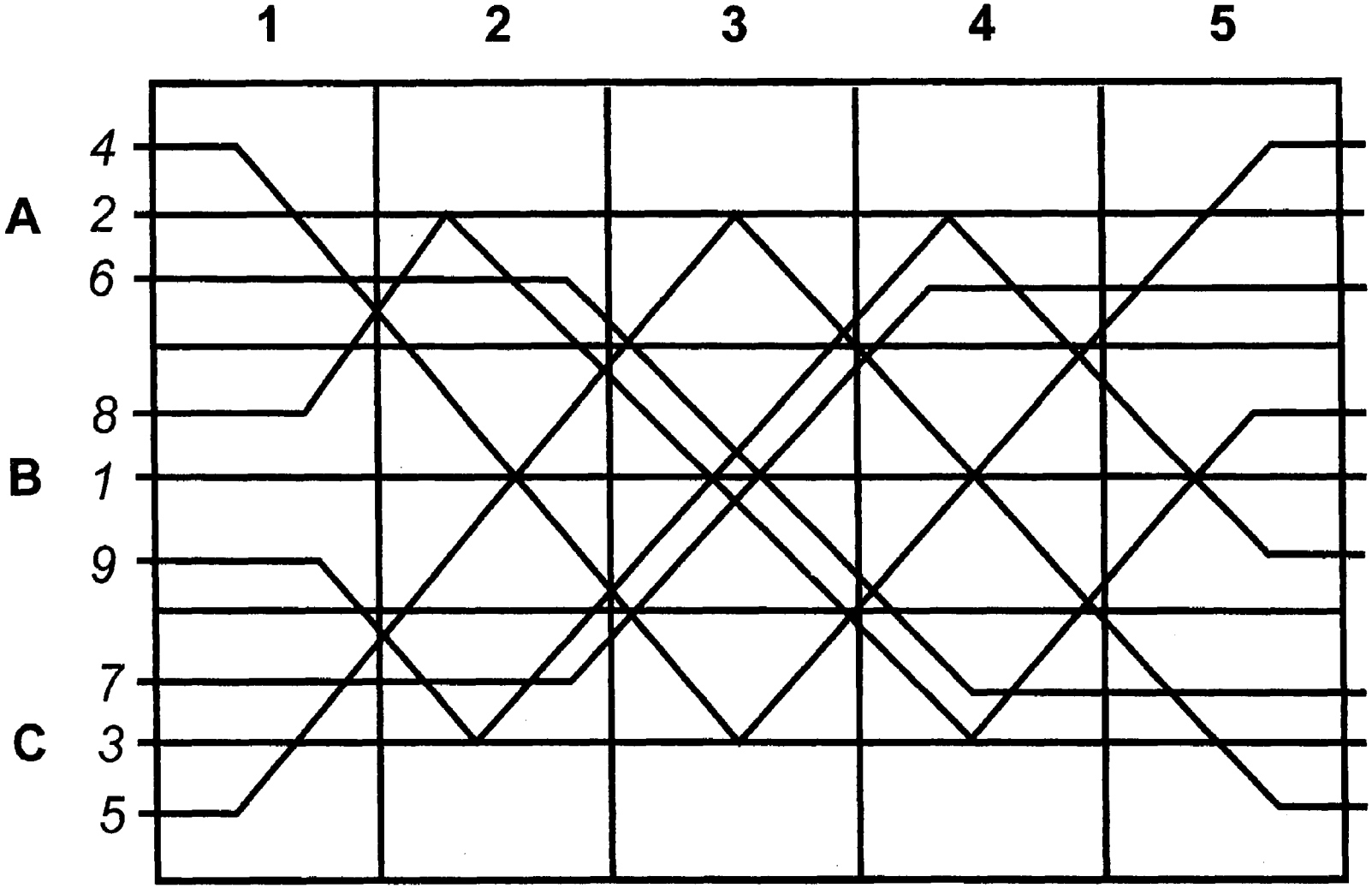
FIG. 5 is a schematic depiction of nine pay lines on a 5×3 reel matrix.

A preferred embodiment has a 5×3 positions video format with five virtual reels shown in columns and in which three usable symbols appear on each reel. Thus, there are three rows across the five columns, see FIG. 5. The preferred embodiment also uses a plurality of 9 or 15 pay lines, such as found in the current popular casino games. As an example illustrated in FIG. 5, the preferred 9 pay lines are as follows (using a nomenclature wherein the reels are numbered with columns 1-5 left to right, and the positions or rows on each reel are lettered A-C from top to bottom:

| Pay line # | Symbol sequence |
|---|---|
| 1 | 1B 2B 3B 4B 5B |
| 2 | 1A 2A 3A 4A 5A |
| 3 | 1C 2C 3C 4C 5C |
| 4 | 1A 2B 3C 4B 5A |
| 5 | 1C 2B 3A 4B 5C |
| 6 | 1A 2A 3B 4C 5C |
| 7 | 1C 2C 3B 4A 5A |
| 8 | 1B 2A 3B 4C 5B |
| 9 | 1B 2C 3B 4A 5B |

The preferred initiation means is the alignment of a special symbol on the rightmost ($5^{th}$) reel in any of the three positions. In so aligning, the player is afforded the opportunity to touch one of the other 14 remaining symbols appearing on the video screen. The player selects a symbol via touch-screen. The position of the touched symbol in the 5×3 reel matrix then becomes wild.

Figure 1:
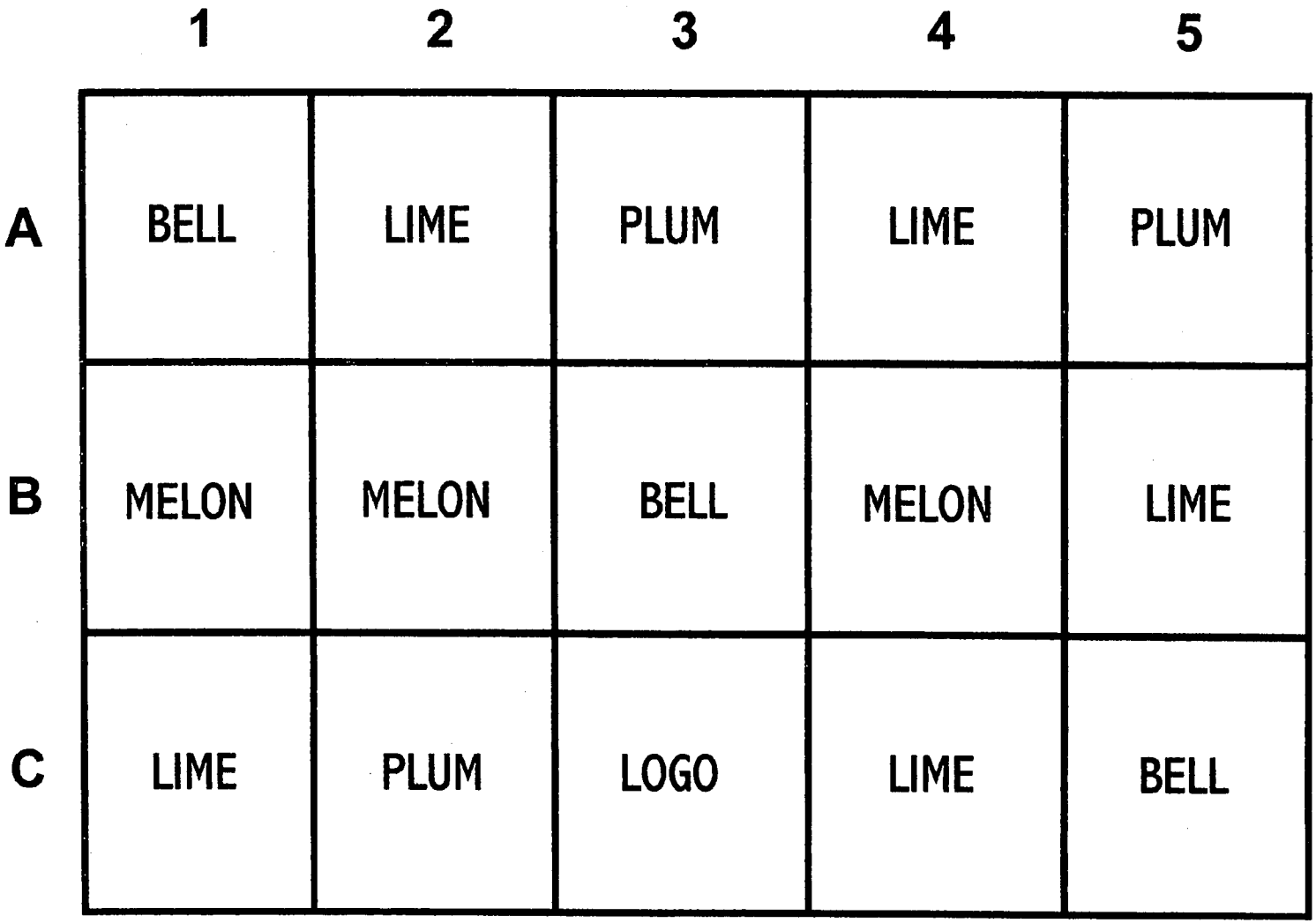
FIG. 1 is a representation of a possible spin outcome.

By way of example, we assume a reel-stop position as depicted in FIG. 1 and a pay table as follows:

All pays x line bet.

Only highest winner paid per pay line.

Logo is wild and substitutes for all other symbols except Trigger.

Trigger anywhere on $5^{th}$ reel initiates Player Selectable Wild feature.

| | |
|---|---|
| Logo Logo Logo Logo Logo | 1000 |
| Logo Logo Logo Logo | 200 |
| Logo Logo Logo | 50 |
| Logo Logo | 10 |
| Logo | 2 |
| Bell Bell Bell Bell Bell | 100 |
| Bell Bell Bell Bell | 25 |

-continued

| | |
|---|---|
| Bell Bell Bell | 10 |
| Plum Plum Plum Plum Plum | 75 |
| Plum Plum Plum Plum | 20 |
| Plum Plum Plum | 10 |
| Melon Melon Melon Melon Melon | 50 |
| Melon Melon Melon Melon | 15 |
| Melon Melon Melon | 5 |
| Lime Lime Lime Lime Lime | 50 |
| Lime Lime Lime Lime | 15 |
| Lime Lime Lime | 5 |

In practice the pay table would be conspicuously placed either on or adjacent to the slot machine (for example, on the slot machine's top glass or belly glass), or within one or more pay table screens (for example, if a video slot machine). What is pertinent is that the player is given ample opportunity, either before or preferably before and during the game, to observe the pay table in order to understand the various winning symbol combinations and their relative value.

In FIG. 1, a player wagering 1 credit on each of the 9 pay lines as already described herein is paid nothing for this spin result.

In FIG. 2, the player is presented an alternative spin outcome. With this result, the player has qualified for the Player Selectable Wild feature because a Trigger symbol has appeared on the $5^{th}$ reel. In practice, at this point, the play would be alerted via multi-media presentation, showing that he/she has qualified for the player wild feature, and instructions would be given. Here, in a first preferred embodiment, the Trigger symbol automatically becomes wild, and the player is prompted to touch any of the other 14 remaining non-trigger symbols, whose position will then also become wild. It can be seen, after consultation with the pay table, that the optimal symbol to touch (and convert to wild) is the Bell at position 3B. The resultant payoff is then a total of 50 credits for pay line 1. The player could have touched Lime at position 2A in FIG. 2 and converted that to wild there would be three Bells at 1A, 2A, and 3B and that would pay only 10 so the prudent player would not select that. Likewise the player could have selected Plum at location 2C and lined up the four Limes winning 15 (remember that Logo is also wild). That also would have been a less fortunate choice. The player, depending on the initiating means, may be given two or more choices among the symbols, with all such choices serving to make the corresponding positions wild.

In FIG. 3, a player wagering 1 credit on each of the 9 lines for this spin, is paid 2 credits for pay line 2, 5 credits for pay line 3, 15 credits for pay line 4, and 2 credits for pay line 6 for a total of 24 credits.

In FIG. 4 is presented an alternative spin outcome for the same player. In this outcome, the player has qualified for the Player Selectable Wild feature because a Trigger symbol has again appeared on the $5^{th}$ reel. Again, at this point, the player would be alerted via multi-media presentation that he/she has qualified for the Player Wild feature, and instructions would be given. Here, in a second preferred embodiment, the Trigger symbol does not become wild and the player is prompted to touch any of the 15 symbols whose position will then become wild. For FIG. 4, it can be seen, after consultation with the pay table, that the optimal symbol to touch (and convert to wild) is the Bell at position 2A. The resultant payoff is then 75 credits for pay line 2, 5 credits for pay line 3, 15 credits for pay line 4, and 5 credits for pay line 6 for a total of 100 credits.

In alternate embodiments, the initiation means may be randomly run, or it may be a function of successive losses, etc. In one embodiment, the player chooses a symbol, and all positions having that same symbol become wild, or some subset such as a particular row, column or symbol. In another embodiment the player must choose from a limited subset of all symbols such as a particular row, column or type of symbol. In yet another embodiment, the positions become wild with an enhanced multiplier for any resultant pays, e.g. 3×. In yet another embodiment, the enhanced multiplier is randomly chosen.

Figure 6:
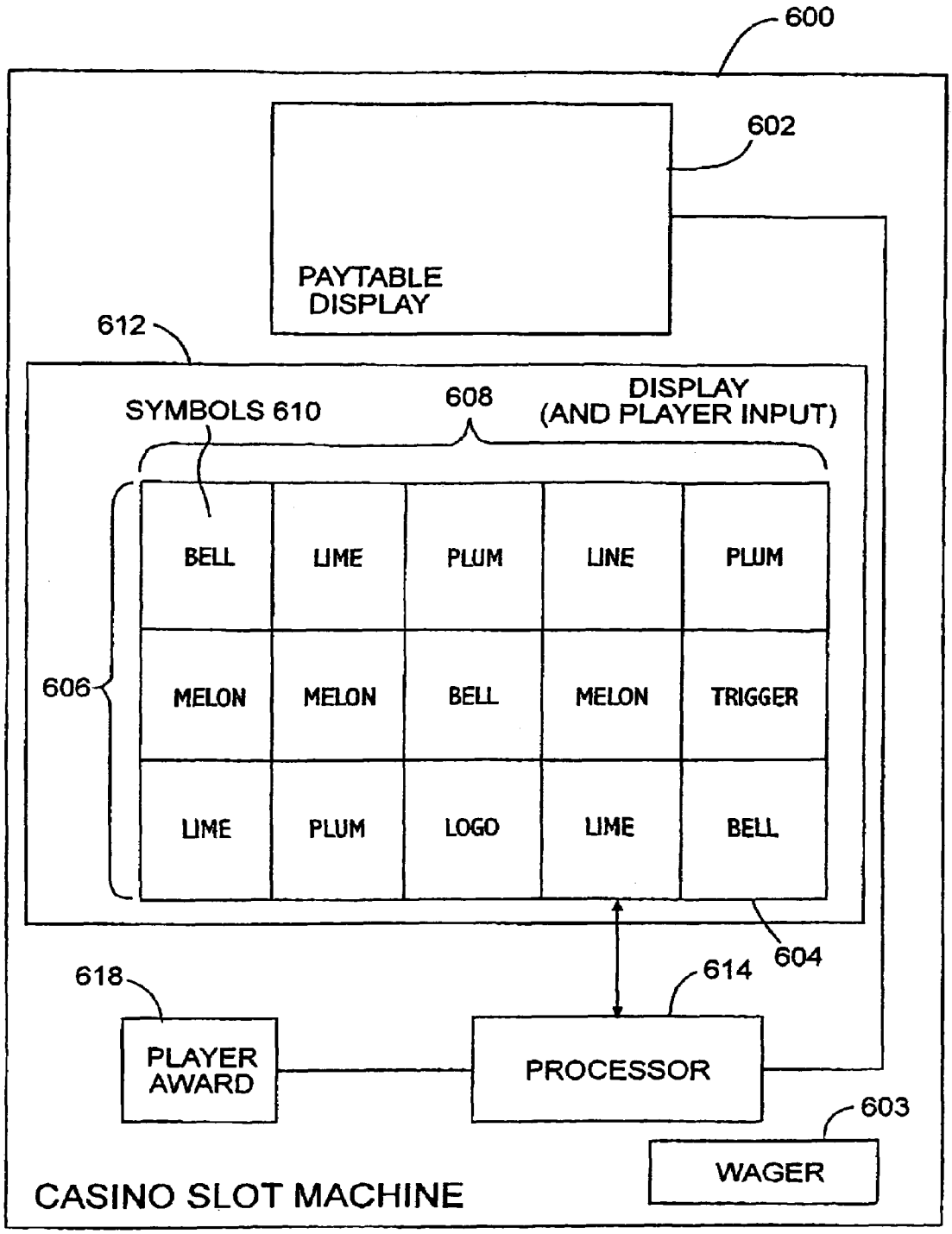
FIG. 6 is a block diagram of an apparatus for playing a casino game according to a preferred embodiment of the present invention.

FIG. 6 shows an apparatus 600 for strategically playing a casino slot machine for a wager 603 which has a display 602 for displaying a pay table and/or rules of play information. A processor 614 is capable of displaying 612 a matrix 604 for a wager 603, the matrix presentation 604 comprising symbols 610 randomly positioned in rows 606 and columns 608. An input means 612 such as a touch screen or one or more controls are available to the player to choose one or more symbols 610. The processor 614 is capable of changing the display 604 of one or more symbols 610 to be wild and awarding the player in accord with the pay table 602 and/or rules of play.

While the examples illustrating the game and its play and different options for methods of execution are explained throughout the preceding disclosure, skilled artisans will appreciate that many variations of the design will be possible. The specific examples of equipment and play should not be considered limiting.

Figure 7:
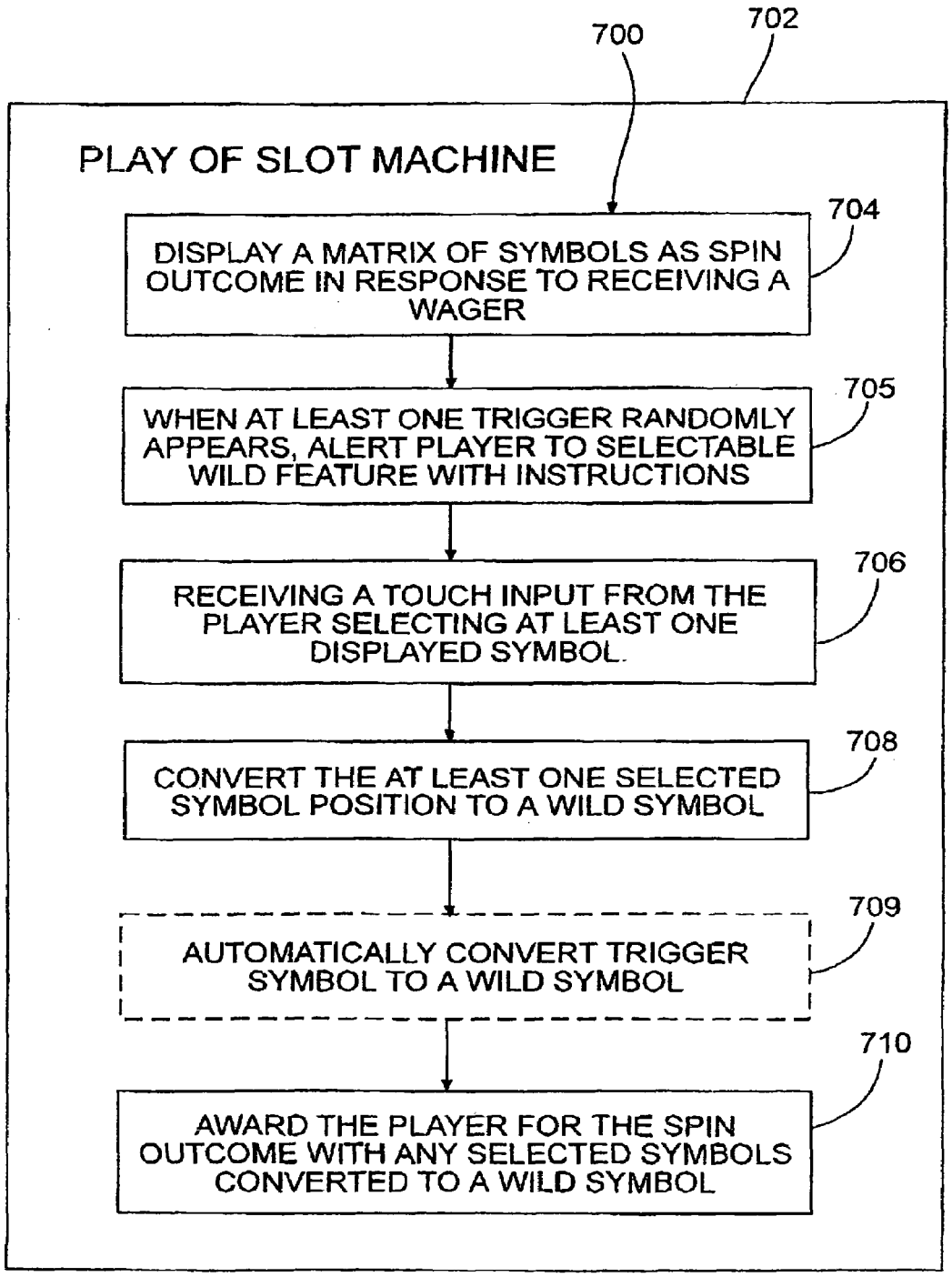
FIG. 7 is a flow chart of a method for playing a game on a slot machine according to a preferred embodiment of the present invention.

FIG. 7 is a flow chart of a method 700 for playing a game on a casino slot machine according to a preferred embodiment of the present invention. Method 700 is played 702 in a casino slot machine and includes: displaying 704 a matrix of symbols as a spin outcome of the slot machine; selecting 706, by a player, at least one of the displayed symbols only when at least one trigger symbol randomly appears in the spin outcome; converting 708 each at least one selected symbol to a wild symbol; and awarding 710 the player in accord with a pay table of the slot machine in response to converting the at least one selected symbol to a wild symbol in said spin outcome.

Figure 8:
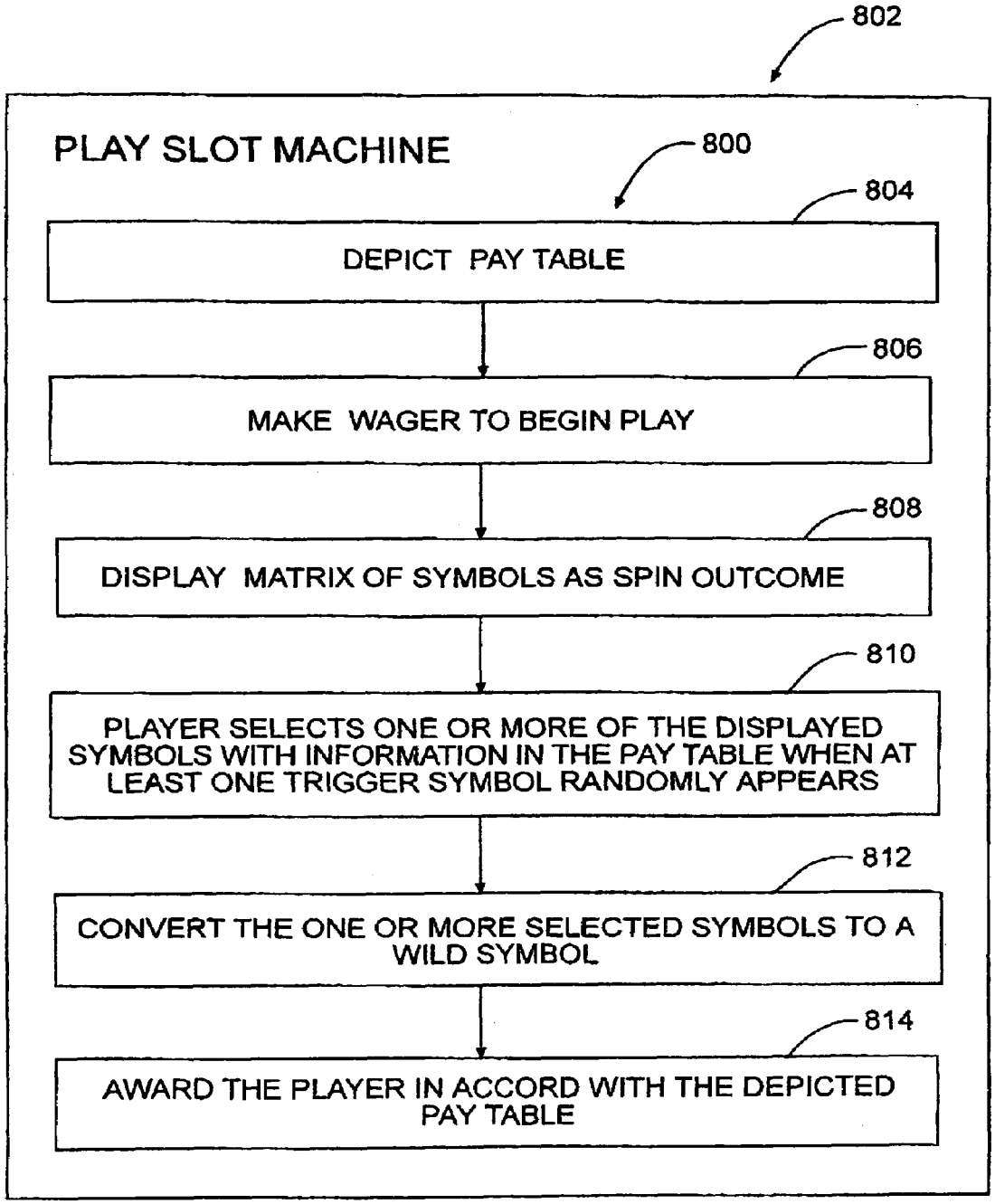
FIG. 8 is a flow chart of a method for playing a game on a slot machine according to a preferred embodiment of the present invention.

FIG. 8 is a flow chart of a method 800 of playing 802 a game on a casino slot machine. The method 800 comprises: depicting 804, on the slot machine, a pay table; allowing a player to make 806 a wager thereby beginning play of the slot machine; displaying 808 a matrix of symbols as a spin outcome of the slot machine; selecting 810, by the player, one or more of the displayed symbols in accordance with information in the depicted pay table, the selecting occurring only when at least one trigger symbol randomly appears in the spin outcome; converting 812 each of the one or more selected symbols to a wild symbol; and awarding 814 the player in accord with depicted pay table in response to converting each of the one or more symbols to a wild symbol in the spin outcome.

Figure 9:
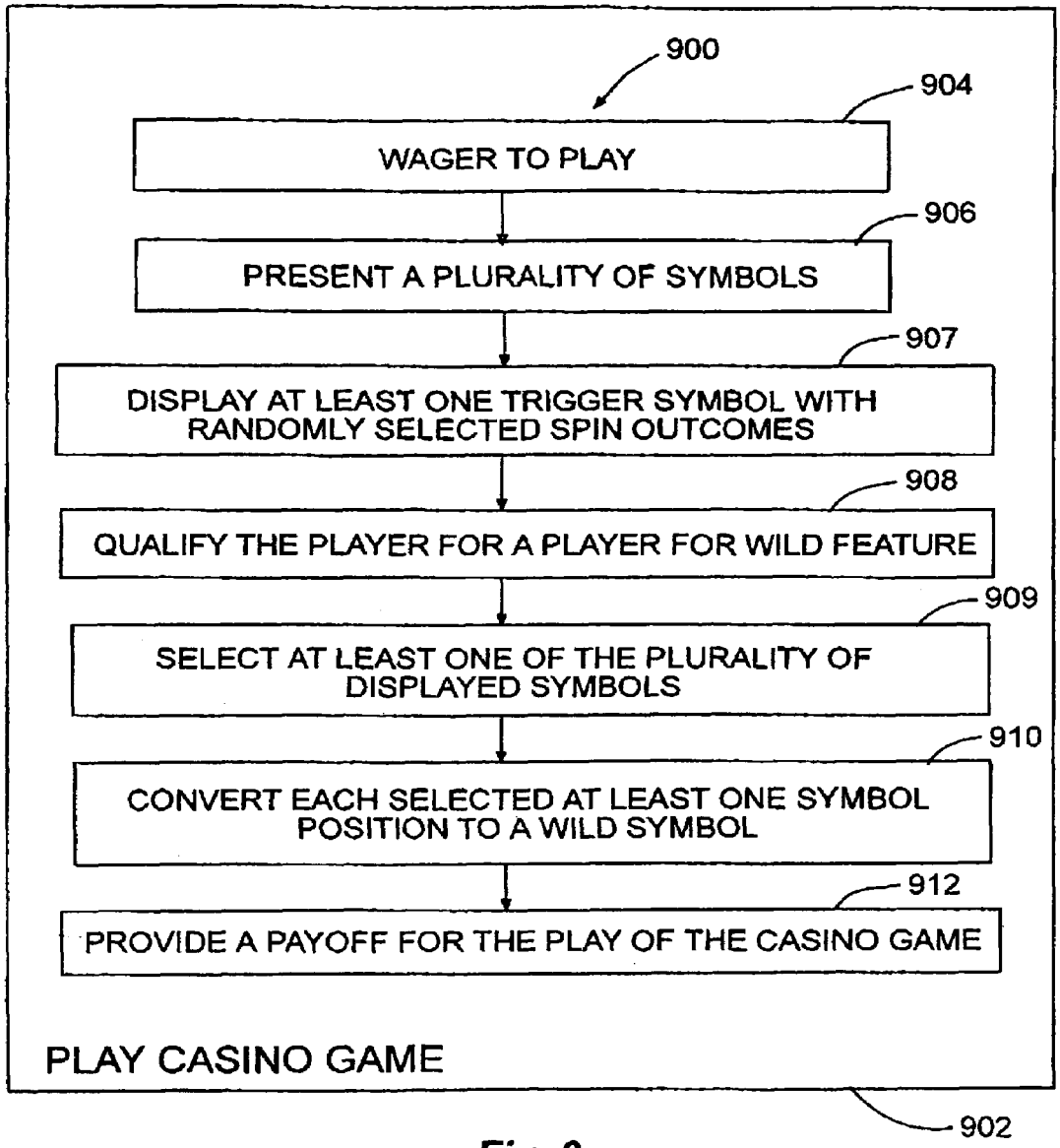
FIG. 9 is a flow chart of a method for playing a casino game according to a preferred embodiment of the present invention.

FIG. 9 is a flow chart of a method 900 of playing 902 a casino game according to a preferred embodiment of the present invention. Method 900 comprises: wagering 904 by a player to play the casino game; presenting 906 the player with a spin outcome in response to the wager, the spin outcome having a plurality of symbols; displaying 907 at least one trigger symbol with the randomly selected spin outcome; qualifying 908 the player for a player wild feature only when the at least one trigger symbol is displayed with the presented spin outcome; selecting 909, by the player during the wild feature, at least one of the plurality of symbols in the spin outcome in response to the qualification of the player; converting 910 to a wild symbol each said selected at least one symbol during the wild feature; providing 912 a pay off for play of the casino game based on the presented spin outcome, when the player is qualified for the wild feature then providing a pay off based on the presented spin outcome with each converted wild symbol.

Figure 10:
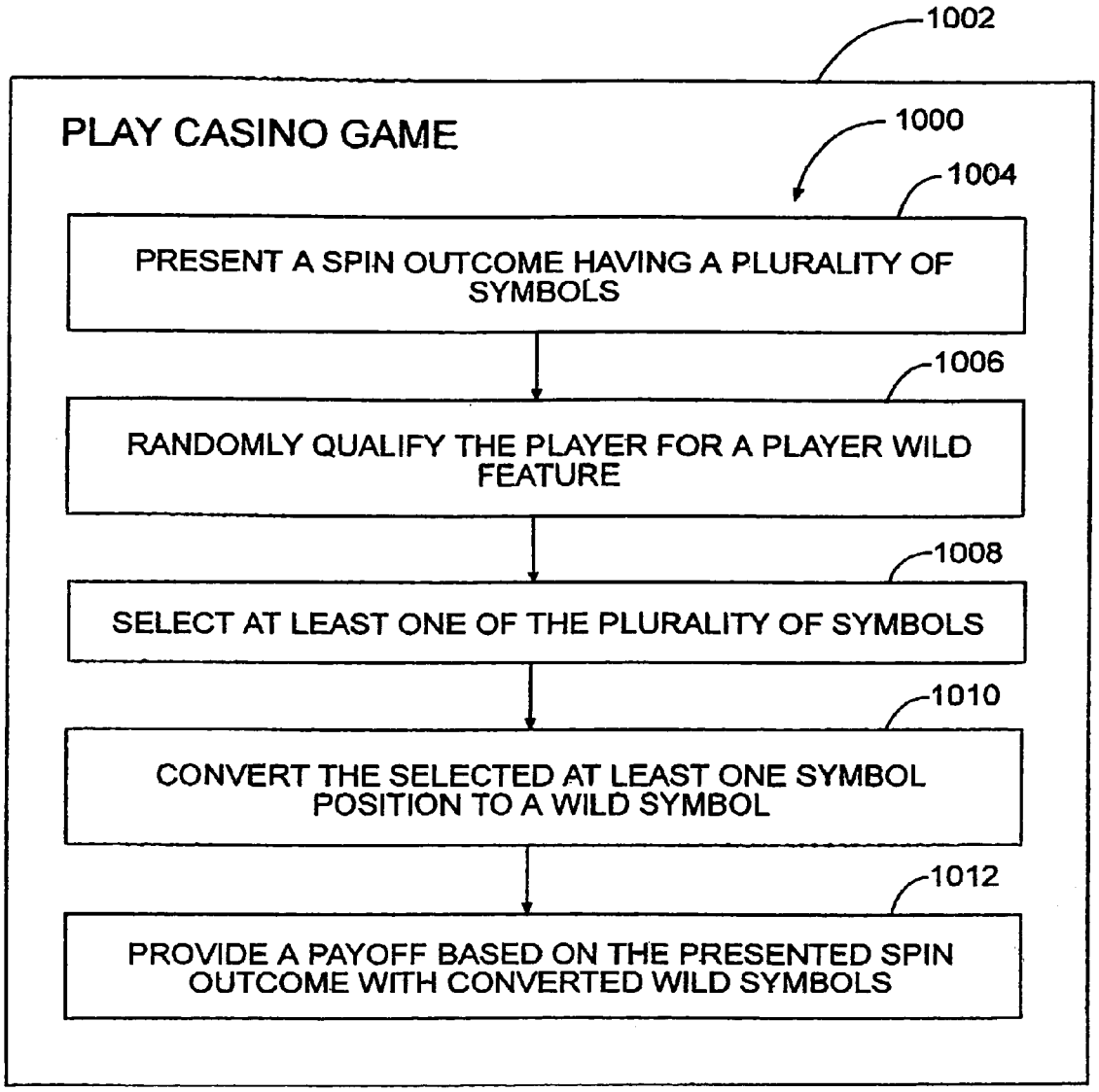
FIG. 10 is a flow chart of a method for playing a casino game according to a preferred embodiment of the present invention.

FIG. 10 is a flow chart of a method 1000 for playing 1002 a casino game according to the preferred embodiment of the present invention. Method 1000 comprises: presenting 1004 a player with a spin outcome in the casino game, the spin outcome having a plurality of symbols; randomly qualifying 1006 the player for a player wild feature during play of the casino game; selecting 1008 by the player at least one of the plurality of symbols in response to qualifying the player for the wild feature; converting 1010 the selected at least one symbol to a wild symbol; and providing 1012 a pay off for the play of the casino game based on the presented spin outcome with each converted wild symbols.

The invention claimed is:

1. A method for operating a casino slot machine, the method comprising the steps of:

randomly displaying a matrix of symbols for a plurality of paylines in a touch screen display as the spin outcome in response to receiving a wager from a player, the casino slot machine having a pay table with winning symbol combinations and corresponding awards;

alerting the player when a player selectable wild feature for the aforesaid spin outcome occurs during the operation of the casino slot machine; the player selectable wild feature providing the player with at least one touch input on at least one of the displayed symbols in the matrix of symbols of the aforesaid spin outcome on the touch screen display so as to obtain any winning symbol combinations having higher corresponding awards based on the pay table than winning combinations found in the aforesaid spin outcome, receiving the at least one touch input from the player on the at least one symbol in the matrix of symbols on the touch screen display for the aforesaid spin outcome in response to alerting the player;

converting the aforesaid at least one touched symbol to a wild symbol in the displayed matrix of symbols for the aforesaid spin outcome on the touch screen display in response to receiving the at least one touch input;

awarding the player awards corresponding to any winning symbol combinations on the plurality of pay lines based on the pay table and in response to converting the at least one touched symbol to the wild symbol in the matrix of symbols of the aforesaid spin outcome.

2. The method of claim 1 wherein said received at least one touch input is only one touch input and wherein said converting further comprises:

converting all other symbols in the displayed matrix of symbols in the aforesaid spin outcome that are the same symbol as the one touched symbol to wild symbols.

3. The method of claim 1 wherein said received at least one touch input is only one touch input and wherein said converting further comprises:

converting all other symbols that are the same as the one touched symbol in a predetermined subset of symbols in the matrix of symbols.

4. The method of claim 3 wherein the predetermined subset of symbols is a predetermined line in said matrix of symbols.

5. The method of claim 1 further comprising:

having an enhanced multiplier with the at least one touched symbol; and employing said enhanced multiplier for said awarding.

6. The method of claim 5 wherein said having an enhanced multiplier comprises:

randomly choosing said enhanced multiplier.

7. The method of claim 1 wherein said received at least one touch input is only one touch input; and wherein said converting further comprises:

converting to a wild symbol each remaining displayed symbol in a predetermined line in said matrix of symbols in said touch screen having the one touched symbol.

8. The method of claim 1 wherein said alerting further comprises:

presenting instructions to the player on how to play the player selectable wild feature in response to alerting the player.

9. The method of claim 8 wherein said presenting further comprises:

providing information in the instructions on strategic symbol touching to enhance the player awards in the player selectable wild feature.

10. The method of claim 1 wherein alerting occurs in a multi-media presentation.

11. The method of claim 1 wherein alerting the player further comprises:

providing the player selectable wild feature randomly based on receiving the wager.

12. The method of claim 1 wherein alerting the player comprises:

providing the player selectable wild feature as a function of successive losses by the player at the casino slot machine.

13. A method for operating a casino slot machine, the method comprising the steps of:

randomly displaying a matrix of symbols for a plurality of paylines in a touch screen display as the spin outcome in response to receiving a wager from a player, the casino slot machine having a pay table with winning symbol combinations and corresponding awards;

alerting the player that the player qualifies for a player selectable wild feature for the aforesaid spin outcome occurs during the operation of the casino slot machine, the player selectable wild feature providing the player with an input for at least one of the displayed symbols in the matrix of symbols so as to obtain any winning symbol combinations having higher corresponding awards based on the pay table than winning combinations found in the aforesaid spin outcome;

presenting instructions to the player on how to play the player selectable wild feature in response to alerting;

receiving, in the casino slot machine from the player, the input for the at least one displayed symbol in the displayed matrix of symbols for the aforesaid spin outcome in response to alerting the player;

converting the aforesaid at feast one displayed symbol receiving the input to a wild symbol in the displayed matrix of symbols for the aforesaid spin outcome in response to receiving the input from the player;

awarding the player for any winning symbol combinations on the plurality of pay lines based on the pay table and in response to converting the at least one displayed symbol receiving the input to the wild symbol in the aforesaid spin outcome.

14. The method of claim 13 wherein said received input is only one touch input and wherein said converting further comprises:

converting all other symbols in the displayed matrix of symbols in the aforesaid spin outcome that are the same symbol as the one touched symbol to wild symbols.

15. The method of claim 13 wherein said received input is only one touch input and wherein said converting further comprises:

converting all other symbols that are the same as the one touched symbol in a predetermined subset of symbols in the matrix of symbols.

16. The method of claim 15 wherein the predetermined subset of symbols is a predetermined line in said matrix of symbols.

17. The method of claim 13 wherein said received input is only one touch input and said display is a touch screen display and wherein said converting further comprises:

converting to a wild symbol each remaining displayed symbol in a predetermined line in said matrix of symbols in said touch screen having the one touched symbol.

18. The method of claim 13 wherein said alerting further comprises:

presenting instructions to the player on how to play the player selectable wild feature in response to alerting the player.

19. The method of claim 18 wherein said presenting further comprises:

providing information in the instructions on strategic symbol touching to enhance the player awards in the player selectable wild feature.

20. A method for operating a casino slot machine, the method comprising the steps of:

randomly displaying a matrix of symbols for a plurality of paylines in a touch screen display as the spin outcome in response to receiving a wager from a player, the casino slot machine having a pay table with winning symbol combinations and corresponding awards;

alerting the player only when a player selectable wild feature for the aforesaid spin outcome randomly occurs during the operation of the casino slot machine; presenting instructions to the player, on the touch screen display, on how to play the player selectable wild feature in response to alerting the player;

providing the player with at least one touch input, in the casino slot machine on at least one of the displayed symbols in the matrix of symbols of the aforesaid spin outcome on the touch screen display so as to obtain any winning symbol combinations having higher corresponding awards based on the pay table than winning combinations found in the aforesaid spin outcome in response to alerting the player;

receiving the at least one touch input from the player on the at least one symbol in the matrix of symbols on the touch screen display for the aforesaid spin outcome in response to providing the player;

converting the aforesaid at least one touched symbol to a wild symbol in the displayed matrix of symbols for the aforesaid spin outcome on the touch screen display in response to receiving the at least touch input;

awarding the player awards, in the casino slot machine, corresponding to any winning symbol combinations on the plurality of pay lines based on the pay table and in response to converting the at feast one touched symbol to the wild symbol fn the matrix of symbols of the aforesaid spin outcome.

* * * * *